US006819202B2

(12) United States Patent
Ralph

(10) Patent No.: US 6,819,202 B2
(45) Date of Patent: Nov. 16, 2004

(54) POWER SPLITTER HAVING COUNTER ROTATING CIRCUIT LINES

(75) Inventor: Loren Ralph, Citrus Heights, CA (US)

(73) Assignee: Scientific Components, Brooklyn, NY (US)

( * ) Notice: Subject to any disclaimer, the term of this patent is extended or adjusted under 35 U.S.C. 154(b) by 42 days.

(21) Appl. No.: 10/364,856

(22) Filed: Feb. 13, 2003

(65) Prior Publication Data

US 2003/0151863 A1 Aug. 14, 2003

Related U.S. Application Data

(60) Provisional application No. 60/356,345, filed on Feb. 13, 2002.

(51) Int. Cl.[7] ..... H01P 5/12
(52) U.S. Cl. ..... 333/125; 333/128; 333/136
(58) Field of Search ..... 333/100, 124, 333/125, 127, 128, 136

(56) References Cited

U.S. PATENT DOCUMENTS 5,426,404 A * 6/1995 Kommrusch et al. ..... 333/246
5,467,064 A * 11/1995 Gu ..... 333/128
5,705,962 A * 1/1998 Fleeger et al. ..... 333/136
5,745,017 A * 4/1998 Ralph ..... 333/116
5,929,729 A * 7/1999 Swarup ..... 333/246
6,525,623 B2 * 2/2003 Sridharan et al. ..... 333/128

* cited by examiner

*Primary Examiner*—Barbara Summons
(74) *Attorney, Agent, or Firm*—Kevin Redmond

(57) ABSTRACT

A power splitter that has a small package size and low cross-talk noise. The power splitter includes a low temperature co-fired ceramic (LTTC) substrate with several layers. Electrical components such as transmission lines and resistors are integrated onto and within the LTCC substrate. The power splitter provides impedance matching and dividing functions. The LTCC substrate has counter rotating spiral shaped circuit lines and electrically conductive vias extending therethrough. The vias are used to connect the power splitter to an external printed circuit board. The vias are also used to make electrical connections between the layers of the LTCC substrate. The counter rotating circuit lines allow the power splitter to have a small package size and low cross-talk noise.

18 Claims, 4 Drawing Sheets

POWER SPLITTER HAVING COUNTER ROTATING CIRCUIT LINES

This application claims the benefit of U.S. Provisional Application No. 60/356,345, filed Feb. 13, 2002.

BACKGROUND

1. Field of the Invention

This invention relates to microwave power splitters in general and more particularly to a power splitter having a small package size.

2. Description of the Prior Art

Power splitters have been made by forming transmission lines on microstrip structures using printed circuit boards. Power splitters have also been fabricated on ceramic substrates using screened on thick film conductors and dielectrics. In some applications, printed circuit board space is extremely limited with additional space just not available. It is desirable that the splitter be as small as possible while still having the proper impedance and not having excessive cross-talk noise. Printed circuit boards have a problem in power splitter applications in that the desired transmission line impedance can be hard to achieve in a small package size due to the low dielectric constant of the printed circuit board material. Ceramic materials have a higher dielectric constant and can achieve the same impedance transmission lines in a smaller size. Unfortunately, using a thick film process to fabricate a multilayered structure is difficult to manufacture on a repeatable and cost effective basis. Further, if the circuit lines are placed too close to each other in the ceramic package, excessive cross-talk noise can result.

While power splitters have been used, they have suffered from taking up excessive space, being difficult to manufacture and having excessive cross-talk noise. A current unmet need exists for a power splitter that is smaller, has low cross-talk noise and that can be easily fabricated.

SUMMARY

It is a feature of the invention to provide a power splitter having a small package size that has repeatable electrical characteristics and low cross-talk noise.

Another feature of the invention is to provide a power splitter that includes a substrate having several layers. A resistor is formed on an outer layer. A first transmission line is formed by a first spiral shaped circuit line formed on an inner layer. A second transmission line is formed by a second spiral shaped circuit line formed on the inner layer. A ground plane is formed on another inner layer. Several vias extend between the layers and provide an electrical connection between the resistor, the ground plane and the circuit lines.

Another feature of the invention is to provide a power splitter that includes a low temperature co-fired ceramic (LTCC) substrate. The LTCC substrate has several layers. Electrical components such as transmission lines and resistors are integrated internally within the LTTC substrate. A pair of counter rotating circuit lines in a spiral are formed on a layer. The circuit lines are joined to input and output pads on layers above and below by vias. A resistor is connected between the output pads. The power splitter provides impedance matching and dividing functions. The LTCC substrate has electrically conductive vias extending therethrough. The vias are used to make electrical connections between layers of the LTCC substrate.

Another feature of the invention is to provide a power splitter that takes up less space and has improved electrical repeatability.

A further feature of the invention is to provide a method of manufacturing a miniature power splitter.

Another feature of the invention is to provide a power splitter with low cross-talk noise.

The invention resides not in any one of these features per se, but rather in the particular combination of all of them herein disclosed and claimed. Those skilled in the art will appreciate that the conception, upon which this disclosure is based, may readily be utilized as a basis for the designing of other structures, methods and systems for carrying out the several purposes of the present invention.

BRIEF DESCRIPTION OF THE DRAWINGS

In order that the invention may be more fully understood, it will now be described, by way of example, with reference to the accompanying drawings in which.

It is noted that the drawings of the invention are not to scale. In the drawings, like numbering represents like elements between the drawings.

DETAILED DESCRIPTION

Figure 1:
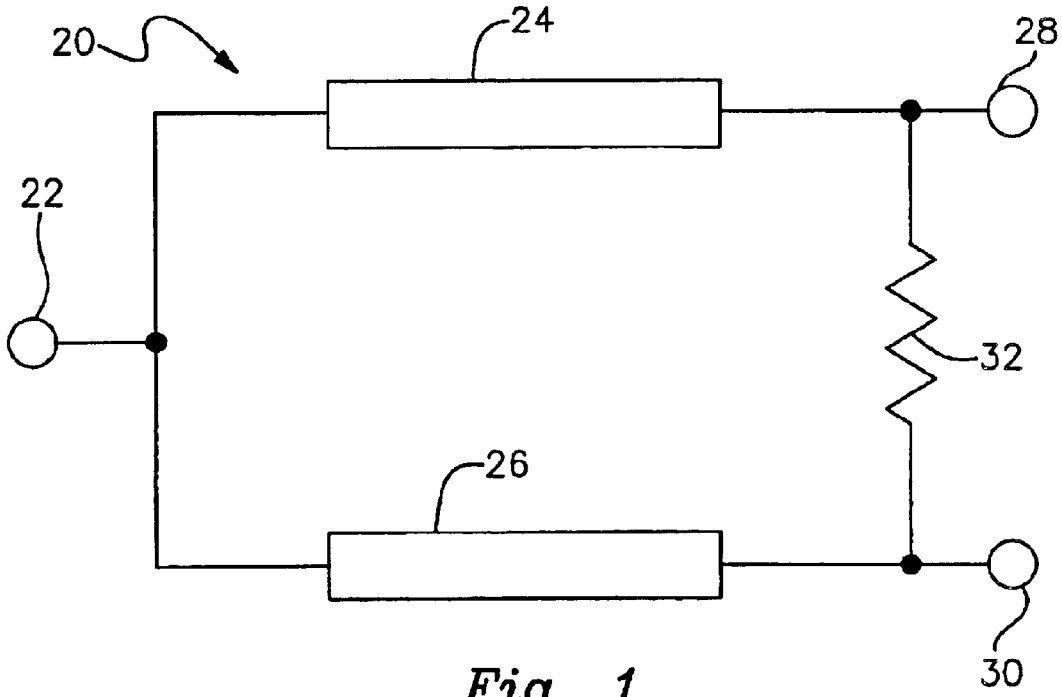
FIG. 1 is a schematic diagram of a microstrip power splitter.

Referring to FIG. 1, a schematic diagram of a microstrip power splitter or divider 20 is shown. Power splitter 20 has an input port 22 that splits to connect with a parallel pair of transmission lines 24 and 26. Transmission line 24 is connected to output port 28 and transmission line 26 is connected to output port 30. An isolation resistor 32 is connected between output ports 28 and 30. For a microstrip power splitter designed to operate around 2 GHz, the transmission lines would have impedances of 70.7 ohms and the resistor 32 would have a value of 100 ohms. The transmission lines are fabricated to be 90 degrees in length to a signal traveling on the line.

Figure 2:
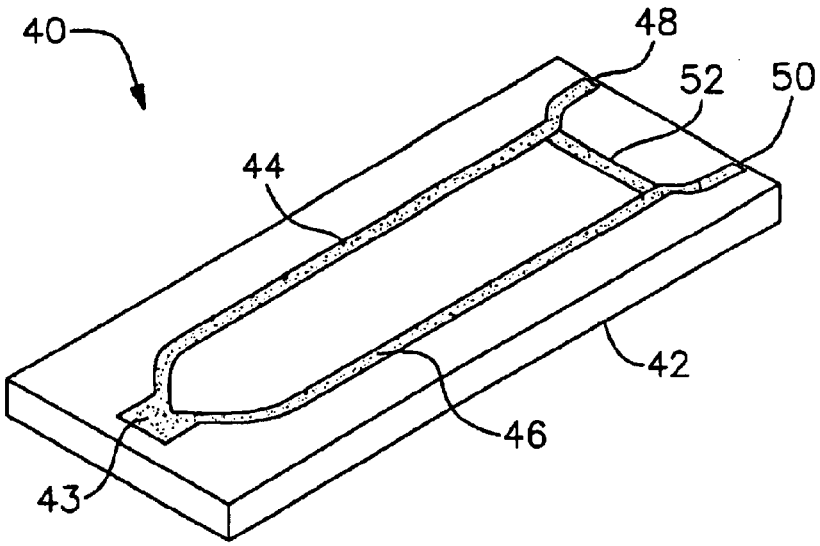
Fig. 2 (Prior Art)
FIG. 2 is a perspective view of a prior art microstrip power splitter.

Referring to FIG. 2, a prior art implementation of the schematic power splitter 20 is shown as microstrip power splitter 40. Power splitter 40 has a ceramic or fiberglass substrate 42 with an input port 43 that splits to connect with a parallel pair of transmission lines 44 and 46. Transmission line 44 is connected to output port 48 and transmission line 46 is connected to output port 50. An isolation resistor 52 is connected between output ports 48 and 50. Transmission lines 44 and 46 are formed by screening and firing a conductive paste onto a ceramic substrate or by etched copper circuit lines on a printed circuit board. The impedance of the circuit lines is a function of the line width, line height, thickness of the substrate and dielectric constant of the substrate. For a microstrip power splitter designed to operate around 2 GHz, the transmission lines would be 10 mils wide by 474 mils long. Substrate 42 would be approximately 0.5 inches long by 0.2 inches wide for an area of 0.1 square inches.

Figure 3:
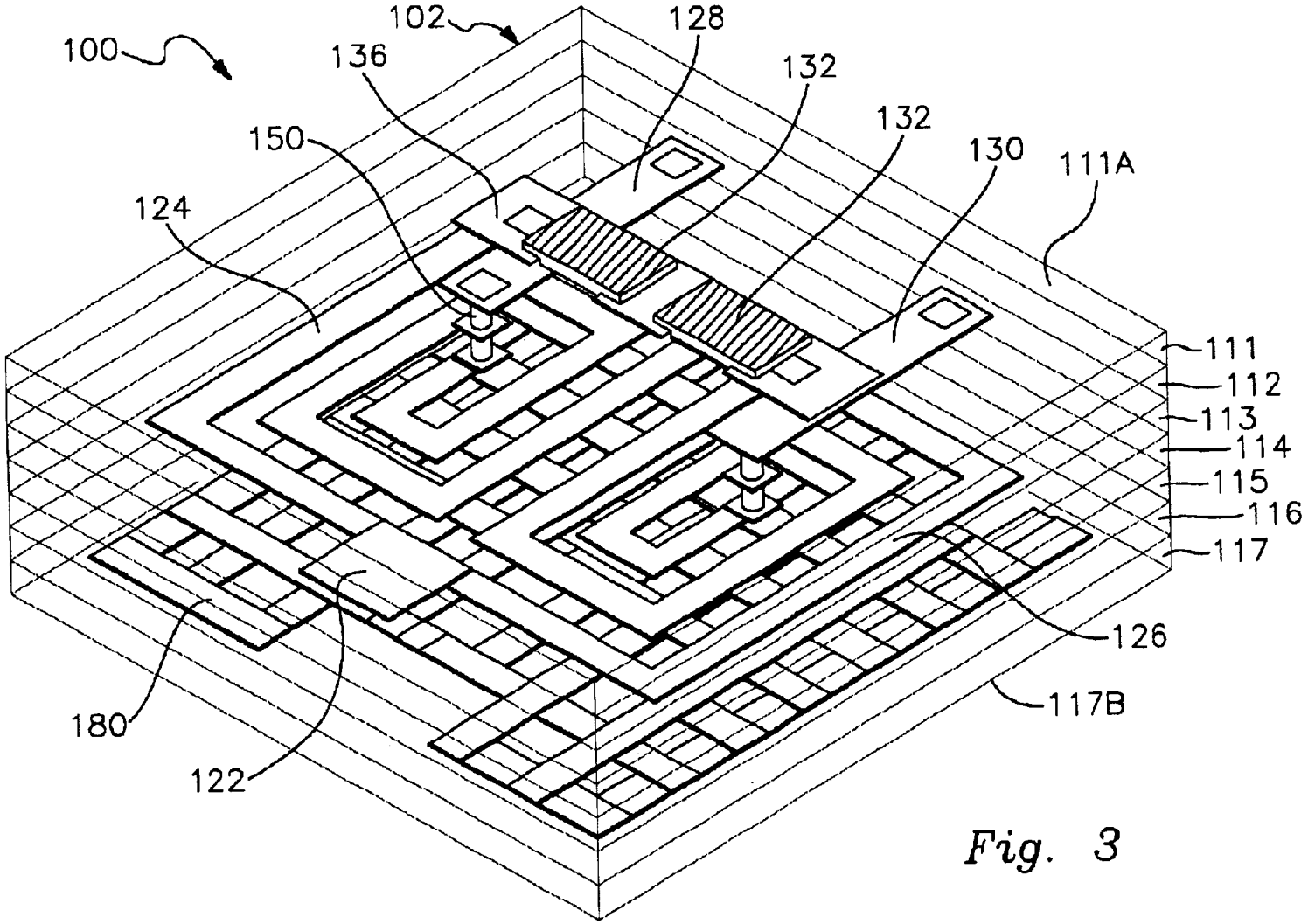
FIG. 3 is a perspective view of the preferred embodiment of the power splitter having counter rotating circuit lines in accordance with the present invention.
Figure 4:
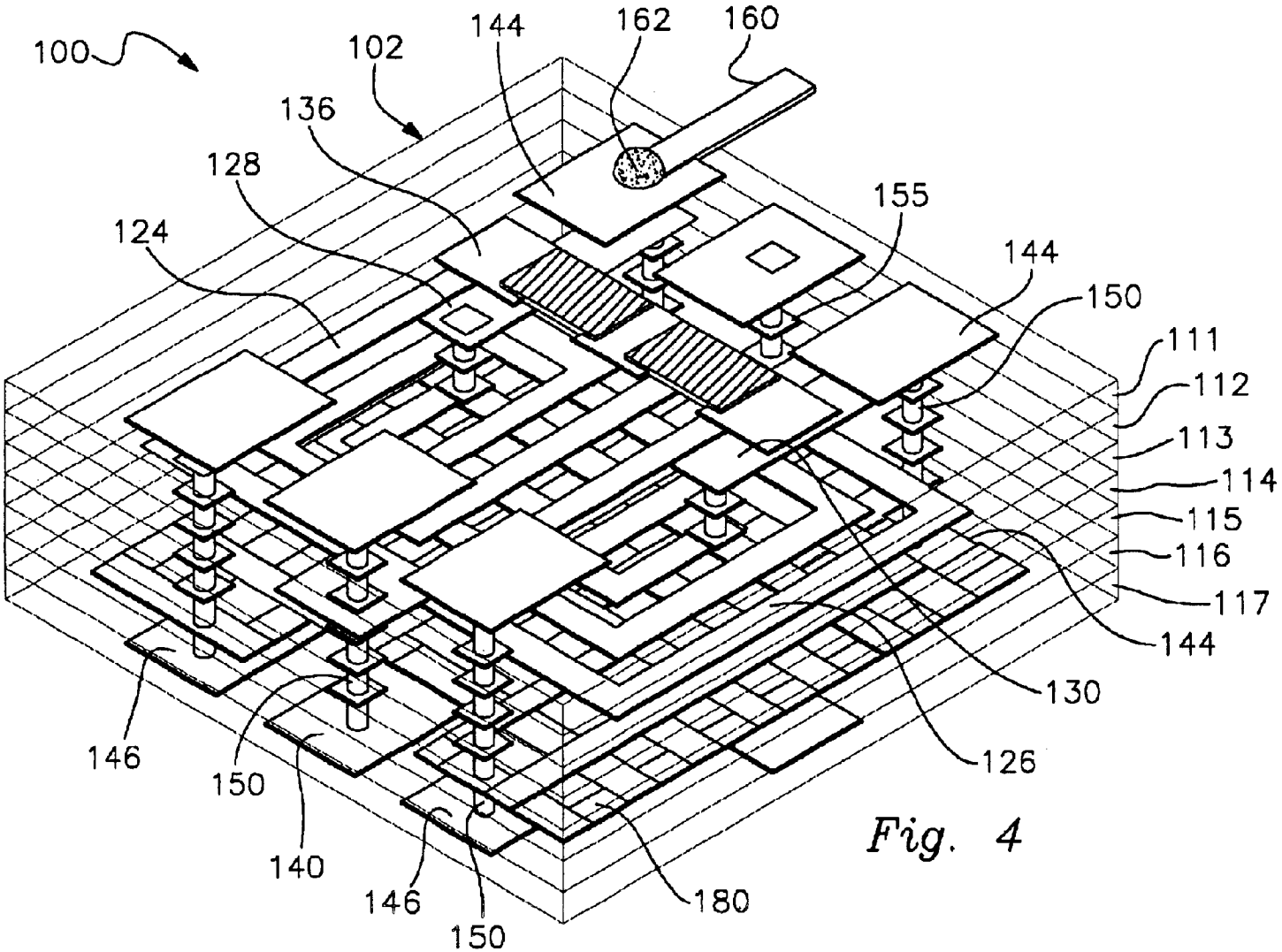
FIG. 4 shows the power splitter of FIG. 3 with the addition of the vias and input and output pads.
Figure 5:
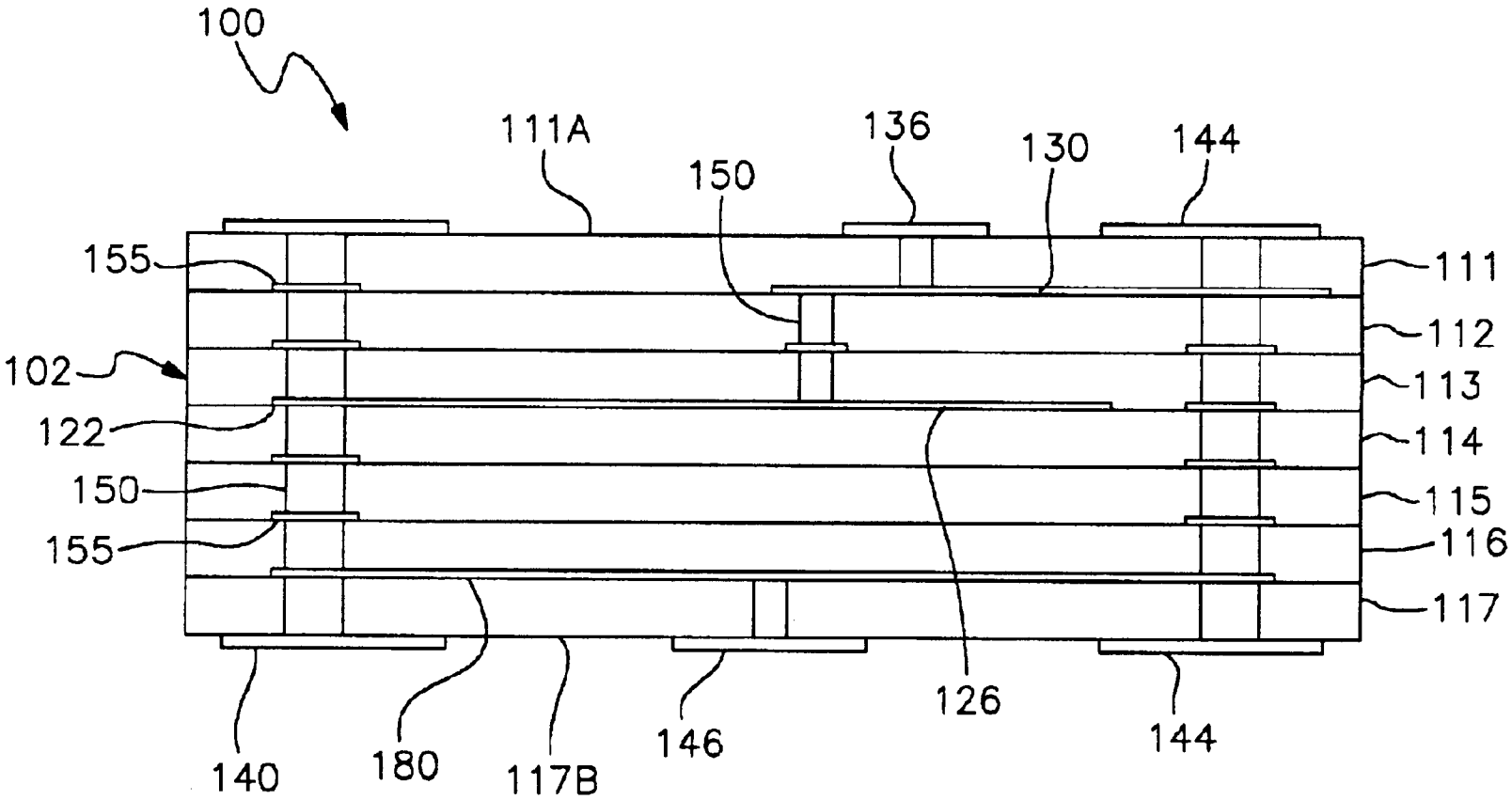
FIG. 5 is a cross-sectional view of FIG. 3.

Referring now to FIGS. 3, 4 and 5, the preferred embodiment of the power splitter having counter rotating circuit lines in accordance with the present invention is shown.

Power splitter 100 has a low temperature co-fired ceramic (LTCC) structure or substrate 102. LTTC substrate 102 is comprised of multiple layers of LTCC material. There are seven LTCC layers in total. Planar layers 111, 112, 113, 114, 115, 116 and 117 are all stacked on top of each other and form a unitary structure 102 after firing in an oven. LTCC layers 111–117 are commercially available in the form of a green unfired tape from Dupont Corporation. Each of the layers has a top surface, 111A, 112A, 113A, 114A, 115A, 116A and 117A. Similarly, each of the layers has a bottom surface, 111B, 112B, 113B, 114B, 115B, 116B and 117B. The layers have several circuit features that are patterned on the top surfaces. Multiple vias 150 extend through each of the layers. Vias 150 are formed from an electrically conductive material and electrically connect one layer to another layer. A via pad 155 extends around each via 150 on the top and bottom surfaces and allows the vias to electrically connect with each other.

Layer 111 has several circuit features that are patterned on surface 111A. Surface 111A has output pads 144, resistors 132, resistor pads 136 and probe pad 134. Output pads 144 form output ports 28 and 30. Placing the resistors 132 on the outer surface allows for laser trimming and for lower capacitance to ground. Forming the resistor as two resistors 132 allows the resistors to be measured in parallel. A lead frame 160 is shown soldered to pad 144 using solder 162. Several lead frames would be soldered to the pads in order to connect the power splitter to other electrical components. Splitter 100 is usually mounted to a printed circuit board.

Layer 112 has a pair of circuit lines 128 and 130 that are patterned on surface 111A. Vias 150 connect the circuit lines 128 and 130 to output pads 144 on layer 111. Layer 113 has no patterning. Vias 150 only pass through layer 113. Layer 114 has a pair of spiral shaped counter rotating circuit lines 124 and 126 that are patterned on surface 114A. Layer 114 also has a T-junction 122 where the circuit lines 124 and 126 join. The spiral circuit lines 124 and 126 terminate in the middle of the spiral and connect to a vias 150 which connects with the circuit lines 128 and 130 on layer 112. It is noted that circuit line 124 spirals clockwise going toward the center. Circuit line 126 spirals counter-clockwise going toward the center. T-junction 122 is connected to input pad 140 by vias 150. Circuit line 124 forms transmission line 24 and circuit line 126 forms transmission lines 26. Input pad 140 forms input port 22. Input pad 140 preferably has a lower impedance to provide a better impedance match. Spiraling the circuit lines 124 and 126 raises the impedance of the lines allowing the circuit lines to be closer to the ground plane for a given line width and impedance value.

Layers 115 and 116 have no patterning. Vias 150 only pass through these layers. Layer 117 has a mesh ground plane 180 that is patterned on surface 117A. input pad 140, output pad 144 and ground pads 146 are patterned on surface 117B. Vias 150 connect the mesh ground plane 180 to ground pads 146 through layer 117. The mesh ground plane 180 helps to prevent warping of the LTCC structure during fabrication and also acts as an impedance reference plane and reduces cross-talk noise.

The circuit features are formed by screening a thick film paste material and firing in an oven. This process is well known in the art. First, the LTCC layers have via holes punched, the vias are then filled with a conductive material. Next, the circuit features are screened onto the layers. The resistors are formed with a resistor material. The pads and circuit lines are formed with a conductive material. An insulative overglaze (not shown) can be screened over the resistor. The layers are then aligned and stacked on top of each other to form LTCC substrate 102. The LTCC structure 102 is then fired in an oven at approximately 900 degrees centigrade to form a unitary piece. The resistors 132 can then be laser trimmed to adjust their resistance value using pads 134 and 136 to probe the resistor during laser trimming. The power splitter 100 would be mounted to a printed circuit board by soldering lead frames 160.

The present invention has several advantages. Since, the circuit lines 124 and 126 are coiled, they take up less space, resulting in a smaller package. A power splitter 100 operating at 2 GHz would have a package size of 0.2 inches by 0.2 inches. This is 0.04 square inches which is 60 percent less area than the prior art design. This provides a savings of space on the printed circuit board and allows for a faster assembly process at lower cost. The frequency of operation of the power splitter can be adjusted by scaling the size of the coiled lines 124 and 126. The line width and spacing is held constant, while the line length is varied.

Repeatability of electrical performance is a prime concern for electrical design engineers. Fabricating the power splitter using an LTCC process results in a more uniform electrical performance in the resulting power splitter. The LTCC layers have tightly controlled tolerances that provide well defined RF characteristics. The mesh ground plane provides for lower noise.

While the invention was shown using seven LTCC layers, it is possible to use more or fewer LTCC layers. Also, several power splitters could be combined into one package.

While the invention was shown applied to a power splitter, it is contemplated to use the same packaging methodology to fabricate other devices such as filters and microwave components.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the description. All changes that come within the meaning and range of equivalency of the claims are to be embraced within their scope.

What is claimed is:

1. A power splitter comprising:

a) a substrate having a top surface, a bottom surface and a plurality of layers;

b) a resistor formed on the top surface;

c) a first transmission line formed by a first spiral shaped circuit line formed on an inner layer;

d) a second transmission line formed by a second spiral shaped circuit line formed on the inner layer;

e) a ground plane formed on another inner layer;

f) a first set of pads located on the top surface;

g) a pair of resistor pads located on the top surface, the resistor connected between the resistor pads;

h) a second set of pads located on the bottom surface;

i) a first set of vias extending through the layers between the first and second set of pads; and j) a second set of vias extending between the resistor pads and the first and second spiral shaped circuit lines.

2. The power splitter according to claim 1 wherein the substrate is formed from layers of low temperature co-fired ceramic.

3. The power splitter according to claim 1 wherein the first set of pads are electrically connected to a lead frame.

4. The power splitter according to claim 3 wherein the first spiral shaped circuit line spirals in a clockwise direction and the second spiral shaped circuit line spirals in a counter-clockwise direction.

5. A power splitter having an input port and a first and second output port comprising:

a) a multi-layered low temperature co-fired ceramic substrate, the substrate having a first and a second outer surface;

b) at least one resistor located on the first surface, the output ports located on the first surface and the input port located on the second surface, the resistor connected between the first and second output ports;

c) a first spiral shaped circuit line formed on a first inner layer, the first spiral shaped circuit line having a first end and a second end, the first end connected to the input port and the second end connected to the first output port;

d) a second spiral shaped circuit line located adjacent the first spiral shaped circuit line, the second spiral shaped circuit line having a first end and a second end, the first end connected to the input port and the second end connected to the second output port;

e) a mesh ground plane formed on a second inner layer; and f) a plurality of vias extending between the first surface, the second surface and the layers for providing electrical connections through the layers between the resistor, the ground plane and the circuit lines.

6. The power splitter according to claim 5 wherein the first spiral shaped circuit line forms a first transmission line and the second spiral shaped circuit line forms a second transmission line.

7. The power splitter according to claim 6 wherein the first spiral shaped circuit line spirals in a clockwise direction and the second spiral shaped circuit line spirals in a counter-clockwise direction.

8. The power splitter according to claim 5 wherein the input and output ports are formed by a plurality of pads.

9. The power splitter according to claim 8 wherein a probe pad is located on the first surface to allow measuring the resistance of the resistor.

10. The power splitter according to claim 8 wherein a plurality of electrical leads are connected to the pads.

11. A power splitter having an input port and a first and second output port comprising:

a) a multi-layered low temperature co-fired ceramic substrate, the substrate having first, second, third, fourth, fifth, sixth and seventh layers, each layer having a top and bottom surface;

b) at least one resistor located on the first layer;

c) at least one circuit line formed on the second layer;

d) a first spiral shaped circuit line formed on the fourth layer and having a first end and a second end, the first end connected to the input port and the second end connected to the first output port;

e) a second spiral shaped circuit line located adjacent the first spiral shaped circuit line and having a first end and a second end, the first end connected to the input port and the second end connected to the second output port;

f) a ground plane formed on the seventh layer; and g) a plurality of vias extending between the layers for providing electrical connections through the layers between the resistor, the ground plane and the circuit lines.

12. The power splitter according to claim 11 wherein the first spiral shaped circuit line forms a first transmission line and the second spiral shaped circuit line forms a second transmission line.

13. The power splitter according to claim 12 wherein the first spiral shaped circuit line spirals in a clockwise direction and the second spiral shaped circuit line spirals in a counter-clockwise direction.

14. The power splitter according to claim 13 wherein a junction is located on the fourth layer, the first ends of the first and second spiral shaped circuit lines commoned together at the junction, the junction connected to one of the vias.

15. The power splitter according to claim 14 wherein the resistor is connected between the first and second output port in order to provide isolation between the first and second transmission line.

16. The power splitter according to claim 15 wherein the resistor comprises two resistors connected in series with a probe pad located in between.

17. The power splitter according to claim 16 wherein the ground plane is connected to a first and second ground pad through one of the vias.

18. The power splitter according to claim 17 wherein the first ground pad is located on the first layer and the second ground pad is located on the seventh layer.

* * * * *